US005769759A

United States Patent [19]

Alter et al.

[11] Patent Number: 5,769,759

[45] Date of Patent: Jun. 23, 1998

[54] STAIR CLIMBING APPARATUS

[76] Inventors: Joseph W. Alter, 78 S. Woodland Ave., Woodbury, N.J. 08096; James A. Deola, 2584 S. Lincoln Ave., Vineland, N.J. 08360

[21] Appl. No.: 791,398

[22] Filed: Jan. 30, 1997

[51] Int. Cl.[6] ..... A63B 22/02

[52] U.S. Cl. ..... 482/37; 482/54

[58] Field of Search ..... 482/52, 54, 37

[56] References Cited

U.S. PATENT DOCUMENTS

| | | | |
|---|---|---|---|
| 3,592,466 | 7/1971 | Parsons . | |
| 4,211,426 | 7/1980 | Motloch . | |
| 4,645,201 | 2/1987 | Evans . | |
| 4,687,195 | 8/1987 | Potts . | |
| 4,708,338 | 11/1987 | Potts . | |
| 4,726,581 | 2/1988 | Chang . | |
| 4,927,136 | 5/1990 | Leask . | |
| 5,013,031 | 5/1991 | Bull . | |
| 5,145,475 | 9/1992 | Cares . | |
| 5,195,935 | 3/1993 | Fencel . | |
| 5,242,341 | 9/1993 | Yeh . | |
| 5,328,420 | 7/1994 | Allen | 482/52 |
| 5,328,422 | 7/1994 | Nichols | 482/52 |
| 5,352,166 | 10/1994 | Chang | 482/52 |
| 5,556,352 | 9/1996 | Chang | 482/52 |

FOREIGN PATENT DOCUMENTS

| | | |
|---|---|---|
| 6-126001 | 10/1994 | Japan . |
| 1507408 | 9/1989 | U.S.S.R. . |

*Primary Examiner*—Lynne A. Reichard
*Attorney, Agent, or Firm*—Lennox & Murtha, P.A.

[57] ABSTRACT

An apparatus for simulating stair climbing is provided which allows selection of step height. A side member is pivotally mounted to a base and oriented at a selected angle with respect to the base. A displacement mechanism mounted to the base is attached to the side member for rotating the side member with respect to the base. A series of platforms travel in a selected platform path including traveling along the side member. The top surface of each platform is a predetermined horizontal distance from the top surface of an adjacent platform which corresponds to the selected angle.

An apparatus for exercising the muscles of a user is also provided. A frame has a first side and a second side. A first chain loop is disposed on the first side, at least a portion of the first chain moving at a selected angle with respect to the frame. A second chain loop disposed at the second side, at least a portion of the second chain moving at the selected angle with respect to the frame. A platform has at least a pair of diagonally opposed corners in which a first corner of the pair is attached to the first chain loop and a second corner of the pair is attached to the second chain loop. A means for controlling the movement of at least the first chain loop.

18 Claims, 6 Drawing Sheets

STAIR CLIMBING APPARATUS

BACKGROUND OF THE INVENTION

This invention is related to the field of exercise equipment. In particular, the invention is directed to an apparatus for simulating stair climbing.

It has long been appreciated that exercise contributes to the overall health and well-being of people. Exercise not only makes daily living more enjoyable but may also have profound physiological and psychological effects on the exerciser. Due to the increased pace of daily living and the proliferation of labor saving devices, however, there is less time and opportunity to exercise. The increased stress of daily living combined with the decrease in physical exercise can have serious long term detrimental effects on the wellness of people.

To combat this lack of exercise, numerous home exercise units have been developed. Weight machines that locate an individual in various positions and supply loads to resist limb movement are employed to increase the muscular strength of the user. Treadmills present a moving floor on which the user walks or runs at a controlled pace. The surface of the treadmill may be tilted and accelerated, increasing the challenge to the user. Cross country ski machines permit the user to exercise both the upper body and the lower body, sliding feet back and forth on foot pads while alternately pulling on handles.

Stair climbers of various types have become more popular over recent years. In one type, the user places each foot on a lever which pivots about a fixed point. The levers are biased upward, such as by a spring. The user presses his weight down on the levers alternately with each foot, roughly imitating a stair climbing motion as the feet move through defined arcs. Such devices are popular because they allow the user to select the height of each step, as best fits their physiology. However, these devices also permit the user to "cheat" by taking too-short steps, thereby not exercising over a full range of motion. Further, because the user does not physically lift his feet off the lever, it is easy for the user to cheat by supporting his weight on the handrails.

Other stair climbers are similar to small escalators, in which the user tries to climb a descending stair set. These devices require the user to lift his feet from step to step, thereby reducing cheating. Further, these devices provide a natural motion that is identical to stair climbing, improving the user's coordination as well as fitness level. However, the user is unable to select the stair height. Further, these stair climbers do not allow the user to select the angle of the stair incline. Consequently, these apparatus do not necessarily "fit" the user and may be uncomfortable to use.

SUMMARY OF INVENTION

It is an object of an aspect of the present invention to provide a stair climbing apparatus which allows a user to select the step height.

It is a further object of an aspect of the invention to provide a stair climber which allows a user to select the angle at which the stairs are inclined.

It is a further object of an aspect of the invention to provide a stair climbing apparatus which permits the user to select the step height and angle of the stair set while maintaining each step in a horizontal plane.

In accord with one aspect of the invention, an apparatus is provided for simulating stair climbing. A frame has a base. A first conveyor is attached to the frame and travels in a first path. A second conveyor is attached to the frame and travels in a second path. A platform has a substantially rectangular shape with a front left corner, a front right corner, a rear left corner and a rear right corner. A inclined member is mounted to the frame at an angle with respect to the base. The platform travels along the inclined member. The first conveyor is attached to the front left corner of the platform and the second conveyor is attached to the rear right corner of the platform.

Certain implementations of this aspect of the invention provide that: the incline member includes a right side member and a left side member, which side members are pivotally mounted to the frame; the right side member includes an upper rail and a lower rail which are pivotally mounted to the frame and oriented at a selected angle with respect to the base; a displacement mechanism is mounted to the base and connected to the upper rail and the lower rail for rotating the upper rail and the lower rail with respect to the base; the displacement mechanism comprises a column mounted to the base, a rider slidingly mounted to the column and a top member mounted to the rider; an orientation motor is operably engaged to the rider for selectively positioning the rider on the column.

In accord with another aspect of the invention, an apparatus for simulating stair climbing is provided which allows selection of step height. A frame has a base. A side member is pivotally mounted to the base and oriented at a selected angle with respect to the base. A displacement mechanism is mounted to the base and attached to the side member for rotating the side member with respect to the base. A series of platforms travel in a selected platform path with respect to the frame. At least a portion of the path includes traveling along the side member. Each platform has a horizontal top surface. The top surface of each platform on the side member is a predetermined horizontal distance from the top surface of an adjacent platform on the side member. The predetermined distance corresponds to the selected angle.

Certain implementations of this aspect of the invention provide that: the side member comprises an upper rail and a lower rail pivotally attached to the base; pins are mounted to the platform wherein the upper rail and the lower rail extend parallel and the pins ride along the upper rail and the lower rail for the portion of the path; the side member is a first side member and the apparatus further comprises a second side member pivotally mounted to the base at the selected angle, a first conveyor attached to the frame and traveling along a first conveyor path, and a second conveyor attached to the frame and traveling along a second conveyor path, wherein the platform comprises at least a pair of diagonally opposite corners, a first opposite corner attached to the first conveyor and the second opposite corner attached to the second conveyor.

In accord with another aspect of the invention, an apparatus for exercising the muscles of a user is provided. A frame has a first side and a second side. A first chain loop is disposed on the first side, at least a portion of the first chain moving at a selected angle with respect to the frame. A second chain loop disposed at the second side, at least a portion of the second chain moving at the selected angle with respect to the frame. A platform has at least a pair of diagonally opposed corners in which a first corner of the pair is attached to the first chain loop and a second corner of the pair is attached to the second chain loop. A means for controlling the movement of at least the first chain loop.

Certain implementations of this aspect of the invention provide that: a first side member is pivotally mounted to first side of the frame and a second side member is pivotally mounted to the second side of the frame, wherein the first chain loop is attached to sprockets mounted to the first side member and the second chain loop is attached to sprockets mounted to the second side member; the first side member comprises a first upper rail and a first lower rail and the apparatus further comprises a first pin mounted to the first corner, which first pin rides along the first upper rail; the second side member comprises a second upper rail and a second lower rail and the apparatus further comprises a second pin mounted to the second corner, which second pin rides along the second lower rail; a displacement mechanism is mounted to the frame and engaged to the first side member for rotating the side member with respect to the frame.

In accord with another aspect of this invention, an apparatus for simulating stair climbing at a selectable grade is provided. A frame has a base with a left side and a right side. A left column is mounted to the frame. A left rider mounted to the left column. A left upper rail is pivotally mounted to the left side of the base and attached to the left rider. A left lower rail is pivotally mounted to the left side of the base, attached to the left rider and extends parallel to the left upper rail. A right column mounted to the frame. A right rider mounted to the right column. A right upper rail is pivotally mounted to the right side of the base and attached to the right rider. A right lower rail is pivotally mounted to the right side of the base, attached to the right rider and extends parallel to the right upper rail. The apparatus includes at least two platforms, each platform having a substantially rectangular shape with a front left corner, a front right corner, a rear left corner, a rear right corner and a top surface, a front left pin mounted to the front left corner and positioned along the lower left rail, a front right pin mounted to the front right corner and positioned along the lower right rail, a rear left pin mounted to the rear left corner and positioned along the upper left rail, and a rear right pin mounted to the rear right corner and positioned along the upper right rail.

Certain implementations of this aspect of the invention provide that: a left loop is mounted to sprockets on the lower left rail and a right loop mounted to sprockets on the upper right rail, wherein the front left corner is attached to the left loop and the right rear corner is attached to the right loop; the right column and the left column are slidingly mounted to the base at a selectable position and the rails are slidingly attached to the riders; the riders are mounted to the columns at a selected position on the column and wherein the rails are slidingly attached to the riders; an orientation motor is mounted to the frame and a peg is operably engaged to the motor wherein a left belt extends from the peg to the left rider and a right belt extends from the peg to the right rider.

DESCRIPTION OF PREFERRED EMBODIMENTS

Figure 1:
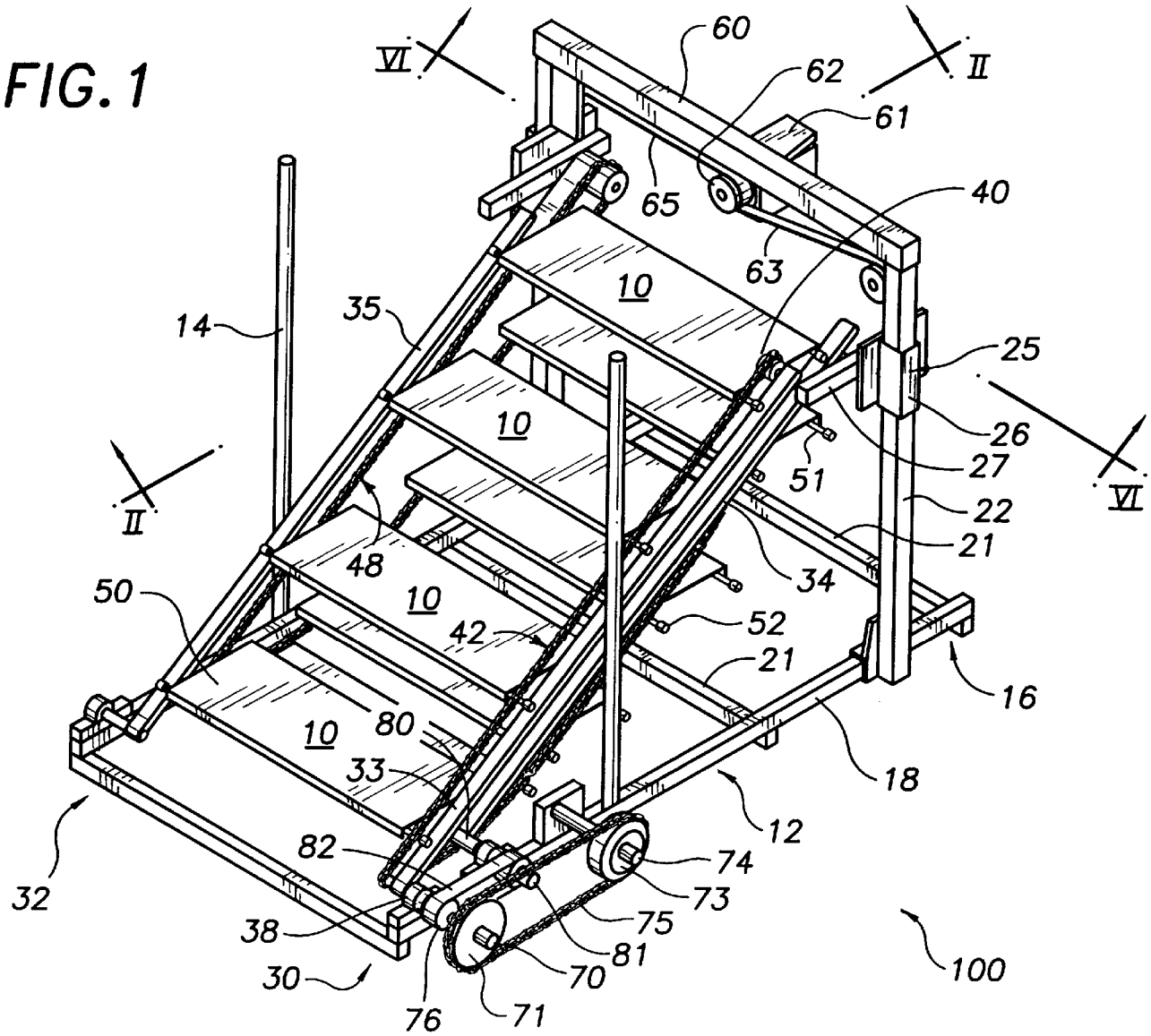
FIG. 1 is a front perspective view of a stair climbing apparatus in accord with an aspect of the invention.
Figure 2:
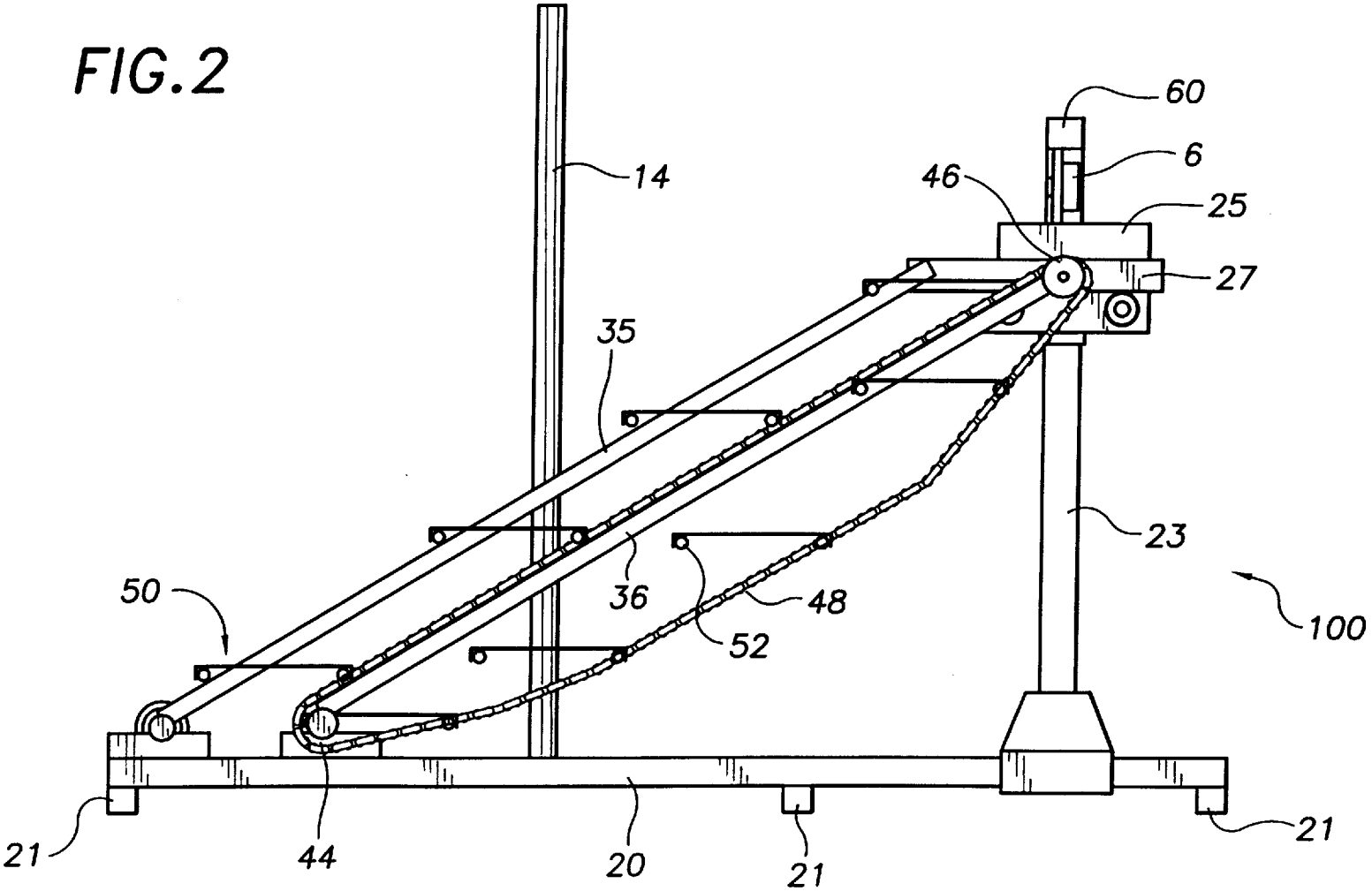
FIG. 2 is a cut-away side view of the stair climbing apparatus of FIG. 1 along line II—II in FIG. 1.

A stair climbing apparatus 100 in accord with an aspect of the invention includes platforms 10 mounted to a frame 12. The platforms are moved in a descending fashion along an inclined member, such as side members 30, 32 which are pivotally attached to the frame. The user climbs upward by stepping from platform to platform, as in actual stair climbing as the platforms descend. As discussed more fully below, a displacement mechanism 200 (see FIG. 6) is mounted to the frame and connected to the side members. The displacement mechanism causes the side members to pivot with respect to the frame, changing the angle of the stair set and the horizontal distance between the platforms on the side members.

A handrail 14 can be provided to stabilize the user during exercise. Typically, the handrail includes a portion that is horizontal or inclined upward but it can have many different shapes. Further, moving handles or the like may be provided to exercise the user's upper body. A computer controller and user-interface console (not shown) can be supplied with motivational software, accelerating and decelerating the stair speed, and altering the stair angle over an exercise program to emulate various topographies. Alternatively, the controller can be a simple switch, actuating the displacement mechanism 200 and, thereby, raising or lowering the step height, as selected by the user.

The frame 12 includes a rectangular base 16 having a lower right beam 18 and a lower left beam 20 connected by cross members 21. Feet having adjustable heights may be provided along the bottom of the base to permit the base to be leveled on an uneven floor surface. Padding or shock absorbers can also be provided along the base to protect the floor surface.

The displacement mechanism 200 includes a right column 22 and a left column 23 rigidly attached to the lower right beam 18 and lower left beam 20, respectively, such as by welding or bolting. The columns extend vertically upward from the lower beams. A rider 25 is attached to each column and can be selectively positioned along the column. As currently preferred, the rider includes a sleeve 26 disposed about the column. A top member 27 is slidingly attached to the sleeve of each rider by bearings or the like. As currently preferred, the top member is at a fixed horizontal orientation. However, the top member can be rotatable, angled or curved, if desired, and still practice the invention. Changing the orientation of the top member will change the orientation of the platforms 10 from horizontal.

Figure 3:
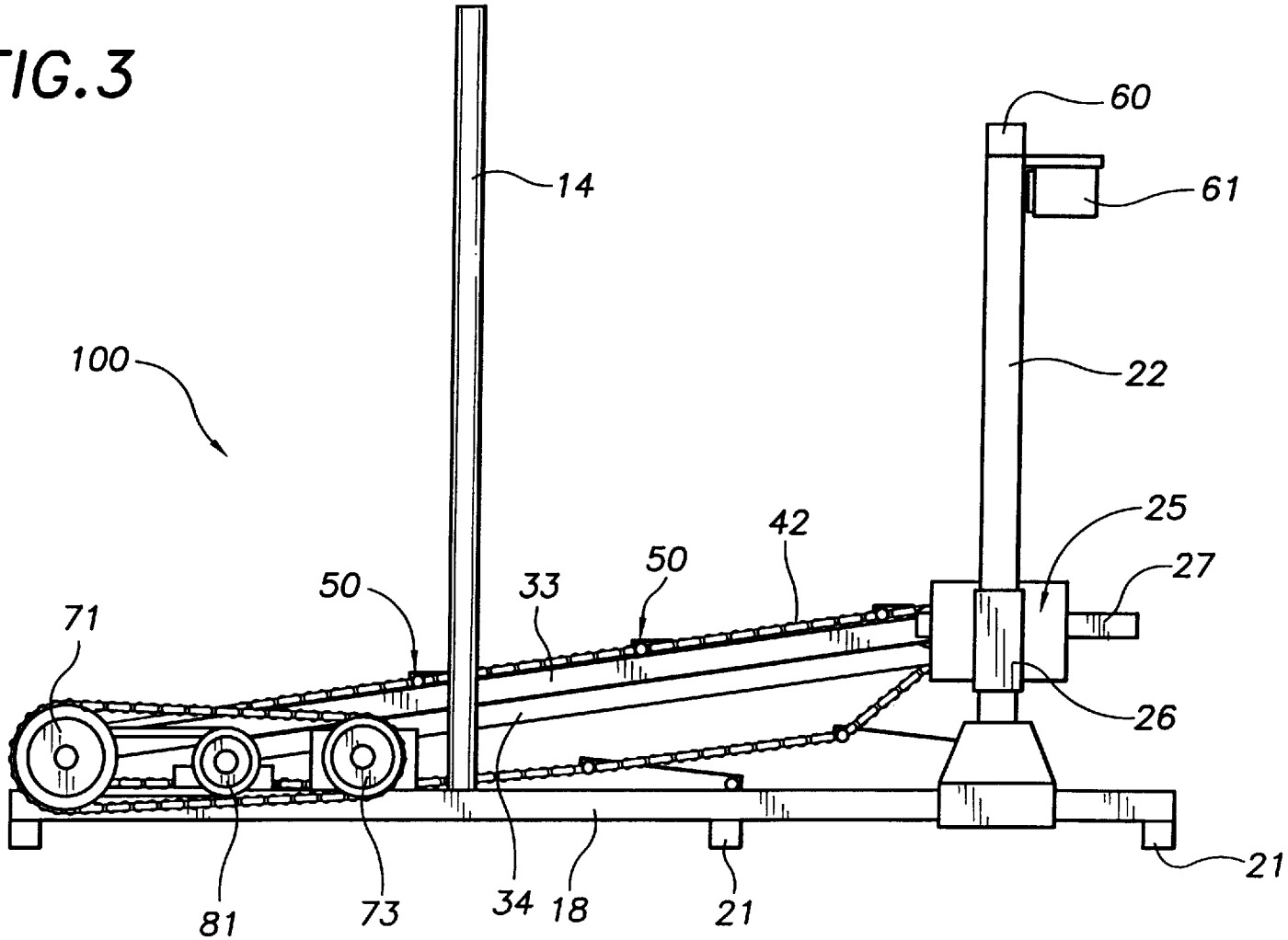
FIG. 3 is a side elevation view of the apparatus of FIG. 1 in a lowered position.
Figure 4:
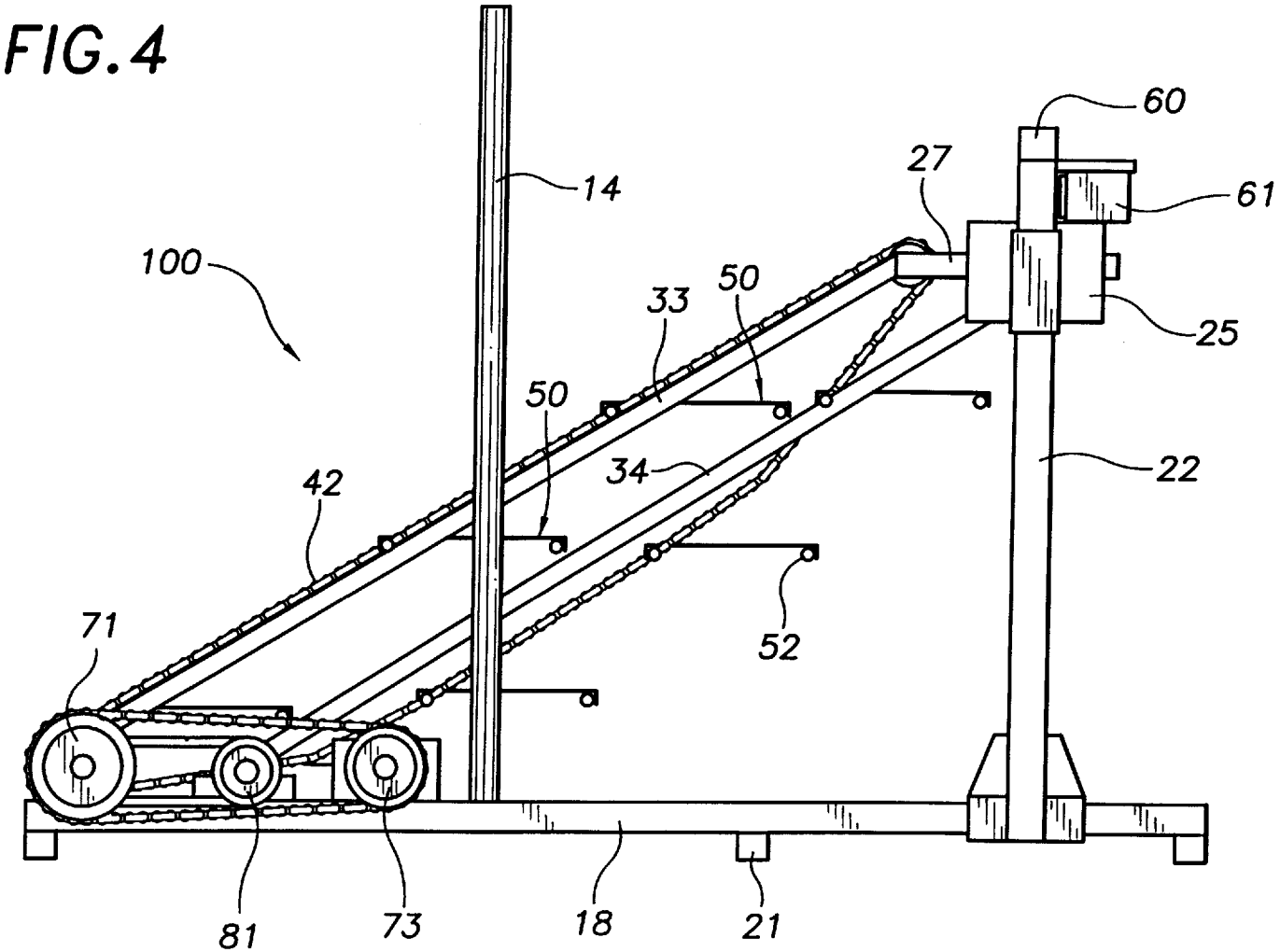
FIG. 4 is a side elevation view of the apparatus of FIG. 1 in a raised position.

A right side member 30 and a left side member 32 are pivotally mounted to the front of the base 16. The right side member 30 includes a right upper rail 33 and a right lower rail 34 which extend parallel to each other. The left side member 32 includes a left upper rail 35 and a left lower rail 36 which extend parallel to each other. The ends of the upper and lower rails distal to the base are pivotally mounted to the respective top members 27 by a pivot. Consequently, as the rider 25 moves up and down the column, the top member slides forward and rearward with respect to the rider (compare FIGS. 3 and 4). The upper rail, top member, lower rail and base 16 form a four-bar linkage such that the rails are maintained parallel although they are rotated with respect to the base 16.

A right lower sprocket 38 is attached to the end of the right top rail 33 near the base 16. A right top sprocket 40 is attached to one end of the right top rail 33. A right conveyor or loop, such as right chain 42, is looped over the right top sprocket and the right lower sprocket. Similarly, a left lower sprocket 44, and a left upper sprocket 46 are attached to the ends of the left lower rail 36. A left conveyor or loop, such as left chain 48, is looped over the left lower sprocket and the left upper sprocket. The left chain and the right chain are thus directed along predetermined paths. A portion of the path for the left chain is parallel to the left side member. A portion of the path for the right chain is parallel to the right side member. While chains are currently preferred for use as conveyors, belts, cables and the like may also be employed.

Each platform 10 has a substantially rectangular shape and a flat upper surface 50. A padded, non-skid or roughened surface may be applied to the upper surface, if desired. Pins 51 are attached to the platform at each corner and extend laterally outward. The pins are attached to the right chain 42 and the left chain 48 at diagonally opposite corners. In particular, the front left corner pin is attached to the left chain and the rear right corner pin is attached to the right chain. Of course, the chains could be attached to the other pair of opposite corners and practice this aspect of the invention.

Since the platforms 10 are attached to the chains 42, 48 which travel in predetermined paths, the platforms also travel in predetermined paths. At least a portion of the platform path includes traveling along the right side member 30 and the left side member 32. The rear pins are positioned on the upper rails 33, 35. The front pins are positioned on the lower rails 34, 36. Preferably, wheels 52, or other rollers, are located at the ends of the pins. The wheels ride along the rails.

The left chain 48 and right chain 42 are attached to the pins 51 such that top surface 50 of the platforms 10 are in horizontal planes and are evenly spaced when the platforms travel along the side members 30, 32. Of course, if desired, the platform may be inclined or declined by altering the connection to the chains or by tilting the top member 27. The rails, top member and base create a four-bar linkage mechanism which will maintain the angle of the platforms on the side members while allowing the overall angle of the stair climbing assembly and the step height to be changed.

Figure 6:
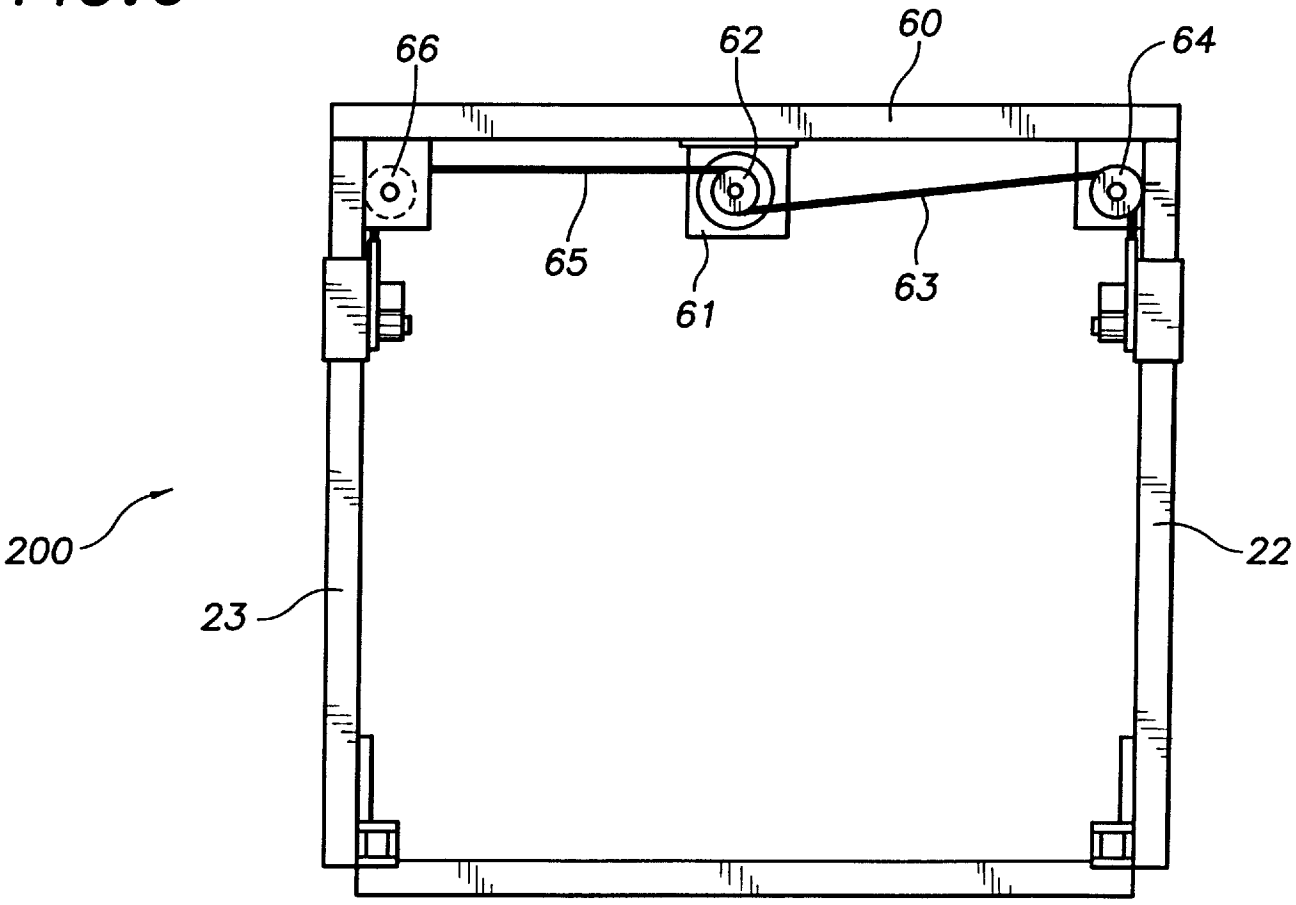
FIG. 6 is a cut-away view along line VI—VI of FIG. 1 of the apparatus in a raised position.

Referring to FIG. 6, the displacement mechanism 200 includes a top cross member 60 extending from the top of the right column 22 to the top of the left column 23. An orientation motor 61 is mounted at the center of the top cross member. A peg 62 is operably engaged to the orientation motor, either directly or through a transmission mechanism. A right belt 63 is attached to the peg and extends over a pulley 64 to the right rider 27. A left belt 65 is attached to the peg and extends over a pulley 66 to the left rider 27. When the orientation motor is actuated in one direction (clockwise in FIG. 6), the belts are rolled onto the peg, causing the riders to rise up along the columns. When the orientation motor is accuated in the other direction (counterclockwise in FIG. 6), the belts are unfurled from the peg, and the riders are lowered along the columns.

Alternatively, the displacement mechanism 200 may include the columns 22, 23 slidingly mounted to the lower members 18, 20. The riders 25 may then be fixedly attached to the columns. A lock (not shown) maintains the columns in a selected position along the lower members. As the columns are moved, the rails are caused to rotate, thereby changing the angle of the stair set and the step height.

Other displacement mechanisms 200 may be employed to control the angle of the side members. For example, a sprocket may be rigidly attached to the side members 30, 32 and driven directly (or via a transmission) by a motor. Alternatively, the side members may be positioned on the columns manually and held in place by a locking mechanism, such as a detent or the like. Numerous other displacement mechanisms may be employed, as one skilled in the art would appreciate.

Figure 5:
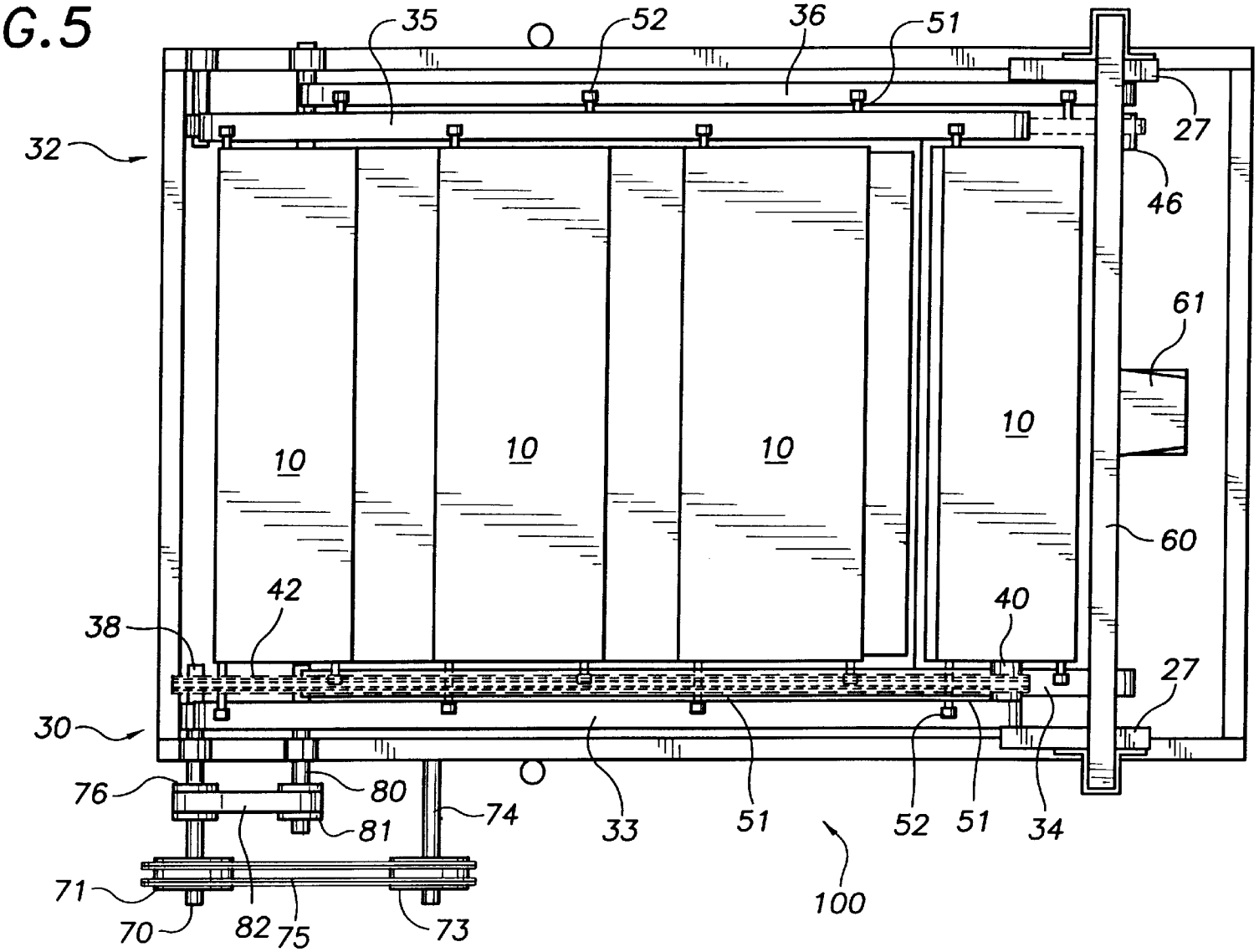
FIG. 5 is a top view of the apparatus of FIG. 1 in a raised position.

The motion of the platforms 10 along the platform path is controlled by controlling the motion of the chains 42, 48 along their conveyors paths. As currently preferred, a controlled motor drives the chains. Of course, various other mechanisms well known in the art could also be employed. Referring to FIGS. 1 and 5, a right driving axle 70 is rotatably mounted to the right lower beam 18. One end of the right driving axle is disposed proximate to the bottom of the right upper rail 33. The right lower sprocket 38 is attached to this end of the right driving axle. The other end of the right driving axle is disposed outside the right lower member. A driving cog 71 is attached to this end of the right driving axle.

A motor cog 73 is rotatably mounted to the right lower beam 18 by a motor axle 74. The drive shaft of a motor (not shown) may be attached to the motor cog, either directly or through a transmission. The motor may be operably engaged to a user-interface console and controlled in various ways known in the art. A drive chain 75 is looped over the motor cog and the driving cog 71.

A left driving axle 80 is rotatably mounted to the base 16. One end of the left driving axle is disposed proximate the left lower rail 36. The other end of the left driving axle is disposed outside the right lower beam 18. A left pulley 81 is mounted on the left driving axle. A right pulley 76 is mounted on the right driving axle 70. A friction belt 82 is looped around the right pulley and the left pulley.

To operate the stair climbing apparatus 100, the user provides various input to a console as is well-known in the art. Typical input includes the weight of the user, the time period of exercise, the height between steps or the angle of the stair set. The apparatus may be provided with motivational software which will vary the speed of the stairs and the step height over an exercise course.

The user can also directly actuate the displacement mechanism 200, including orientation motor 61, in either direction, raising or lowering the step height as desired. Assuming the user desires to lower the step height, the orientation motor is actuated such that the peg 62 turns counterclockwise, as seen in FIG. 6. The left belt 65 and right belt 63 are unfurled, causing the riders 25 to be lowered. As the riders are lowered, the right top member 27 and the left top member 27 are lowered. This causes the ends of the right side member 30 and left side member 32 to lower, rotating the side members with respect to the base 16. The top members slide rearwardly along the riders but the rails are maintained in a parallel condition. As a result, the stair incline and the step height are reduced (compare FIGS. 3 and 4).

When the desired step height is achieved, the orientation motor 61 is deactuated, preventing the riders 25 from moving down along the columns 22, 23. Gravity prevents the riders from moving up on the columns. Of course, a more positive two-way control can be provided, connecting the riders to the orientation motor such that the orientation motor prevents the riders from moving up or down.

Once the desired step height is achieved, the platforms 10 are moved along the platform path. The drive shaft of the motor causes the motor cog 73 to rotate, pulling the drive chain 75 over the driving cog 71. As the driving cog rotates, the right drive axle 70 is rotated, thereby driving the right chain 42. As the right drive axle rotates, the friction belt 82 is also driven, causing the left drive axle 80 to rotate. The left drive axle drives the left chain 48. The left chain and the right chain move at the same speed. As the chains move, the pins 51 attached to the chains are also moved. Consequently, the platforms 10 are moved at a controlled rate down the rails. At the bottom of the rails, the pins travel off the rails and around the bottom end of the rails. Suspended only on the chains, the platforms are moved back up to the top of the rails. At the top of the rails, the chains direct the pins back onto the top surface of the rails and down again. This is repeated for the duration of the exercise period. The step height can also be altered during the exercise period.

While this invention has been described with reference to specific embodiments disclosed herein, it is not confined to the details set forth and the patent is intended to include modifications and changes which may come within and extend from the following claims.

I claim:

1. An apparatus for simulating stair climbing comprising:

a frame having a base;

a first conveyor attached to the frame and traveling in a first path;

a second conveyor attached to the frame and traveling in a second path;

a platform having a first side and a second side, with a front corner on the first side and a rear corner on the second side; and an inclined member mounted to the frame at an angle with respect to the base, wherein the platform travels, at least in part, along the member;

wherein the first conveyor is attached to the front corner of the platform and the second conveyor is attached to the rear corner of the platform.

2. The apparatus of claim 1 wherein the inclined member includes a first side member and a second side member, which side members are pivotally mounted to the frame.

3. The apparatus of claim 2 wherein the first side member includes an upper rail and a lower rail which are pivotally mounted to the frame and oriented at a selected angle with respect to the base.

4. The apparatus of claim 3 further comprising a displacement mechanism mounted to the base and connected to the upper rail and the lower rail for rotating the upper rail and the lower rail with respect to the base.

5. The apparatus of claim 4 wherein the displacement mechanism comprises a column mounted to the base, a rider slidingly mounted to the column and a top member slidingly mounted to the rider.

6. The apparatus of claim 5 further comprising an orientation motor operably engaged to the rider for selectively positioning the rider on the column.

7. An apparatus for simulating stair climbing which provides a selectable step height, the apparatus comprising:

a frame having a base:

a side member including an upper rail and a lower rail pivotally mounted to the base and oriented at a selected angle with respect to the base;

a displacement mechanism mounted to the base and attached to the side member for rotating the side member with respect to the base;

a series of platforms traveling in a selected platame, at least a portion of the path including traveling along the side member, wherein each platform has a horizontal top surface and the top surface of a platform on the side member is a predetermined horizontal distance from the top surface of an adjacent platform on the side member and wherein the predetermined distance corresponds to the selected angle: and pins mounted to the platform wherein the upper rail and the lower rail extend parallel and the pins ride along the upper rail and the lower rail for the portion of the path.

8. The apparatus of claim 7 wherein the side member is a first side member, further comprising:

a second side member pivotally mounted to the base at the selected angle;

a first conveyor attached to the frame and traveling along a first conveyor path; and a second conveyor attached to the frame and traveling along a second conveyor path;

wherein the platform comprises at least a pair of diagonally opposite corners, a first opposite corner attached to the first conveyor and the second opposite corner attached to the second conveyor.

9. An apparatus for exercising the muscles of a user comprising:

a frame having a first side and a second side;

a first chain loop disposed on the first side, at least a portion of the first chain moving at a selected angle with respect to the frame;

a second chain loop disposed at the second side, at least a portion of the second chain moving at the selected angle with respect to the frame;

a platform having at least a pair of diagonally opposed corners in which a first corner of the pair is attached to the first chain loop and a second corner of the pair is attached to the second chain loop; and a means for controlling the movement of at least the first chain loop.

10. The apparatus of claim 9 further comprising a first side member pivotally mounted to first side of the frame and a second side member pivotally mounted to the second side of the frame, wherein the first chain loop is attached to sprockets mounted to the first side member and the second chain loop is attached to sprockets mounted to the second side member.

11. The apparatus of claim 10 wherein the first side member comprises a first upper rail and a first lower rail, further comprising a first pin mounted to the first corner, which first pin rides along the first upper rail.

12. The apparatus of claim 11 wherein the second side member comprises a second upper rail and a second lower rail, further comprising a second pin mounted to the second corner, which second pin rides along the second lower rail.

13. The apparatus of claim 10 further comprising a displacement mechanism mounted to the frame and engaged to the first side member for rotating the side member with respect to the frame.

14. An apparatus for simulating stair climbing at a selectable grade comprising:

a frame having a base with a left side and a right side;

a left column mounted to the frame;

a left rider mounted to the left column;

a left upper rail pivotally mounted to the left side of the base and attached to the left rider;

a left lower rail pivotally mounted to the left side of the base, attached to the left rider and extending parallel to the left upper rail;

a right column mounted to the frame;

a right rider mounted to the right column;

a right upper rail pivotally mounted to the right side of the base and attached to the right rider;

a right lower rail pivotally mounted to the right side of the base, attached to the right rider and extending parallel to the right upper rail; and at least two platforms, each platform having:

a substantially rectangular shape with a front left corner, a front right corner, a rear left corner, a rear right corner and a top surface;

a front left pin mounted to the front left corner and positioned along the lower left rail;

a front right pin mounted to the front right corner and positioned along the lower right rail;

a rear left pin mounted to the rear left corner and positioned along the upper left rail; and a rear right pin mounted to the rear right corner and positioned along the upper right rail.

15. The apparatus of claim 14 further comprising a left loop mounted to sprockets on the lower left rail and a right loop mounted to sprockets on the upper right rail, wherein the front left corner is attached to the left loop and the right rear corner is attached to the right loop.

16. The apparatus of claim 14 wherein the right column and the left column are slidingly mounted to the base at a selectable position and wherein the rails are slidingly attached to the riders.

17. The apparatus of claim 14 wherein the riders are mounted to the columns at a selected position on the column and wherein the rails are slidingly attached to the riders.

18. The apparatus of claim 17 further comprising an orientation motor mounted to the frame and a peg operably engaged to the motor wherein a left belt extends from the peg to the left rider and a right belt extends from the peg to the right rider.

* * * * *